US006367095B2

(12) United States Patent
Hubatka et al.

(10) Patent No.: US 6,367,095 B2
(45) Date of Patent: Apr. 9, 2002

(54) FLUSHING DEVICE FOR A TOILET

(75) Inventors: Alex Hubatka, Gallenkappel; Thomas Riehm, Ebnat-Kappel; Paul Wey, Eschenbach, all of (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 09/771,795

(22) Filed: Jan. 29, 2001

Related U.S. Application Data

(63) Continuation-in-part of application No. 08/411,723, filed on Mar. 29, 1995, now abandoned.

(30) Foreign Application Priority Data

Aug. 2, 1993 (CH) ..... 2315/93
Aug. 2, 1994 (WO) ..... PCT/CH94/00157

(51) Int. Cl.[7] ..... E03D 11/02
(52) U.S. Cl. ..... 4/425; 4/354
(58) Field of Search ..... 4/354, 356, 357, 4/358, 361, 422, 425, 423

(56) References Cited

U.S. PATENT DOCUMENTS 452,963 A * 5/1891 Beekman ..... 4/425 X
1,111,747 A * 9/1914 Haas ..... 4/425 X
1,933,518 A * 10/1933 Zwermann ..... 4/425
2,957,181 A * 10/1960 Lamping ..... 4/354
5,502,845 A * 4/1996 Hayashi et al. ..... 4/425 X

* cited by examiner

*Primary Examiner*—Robert M. Fetsuga
(74) *Attorney, Agent, or Firm*—Colleen Law Associates; Robert M. McDermott

(57) ABSTRACT

A flushing device has two water outlets, wherein one outlet is connected to an arch of a trap of the toilet bowl. This outlet is connected to means with which a portion of the flushing water present in a flushing tank can be pressurized and released to this outlet. The water is briefly set into motion with the pressurized flushing water, and more effective emptying of the trap is achieved. The flushing device according to the present invention represents a lower load for the water pipes and operates with less noise than flushing valve-type devices.

18 Claims, 2 Drawing Sheets

FLUSHING DEVICE FOR A TOILET

CROSS-REFERENCE TO RELATED APPLICATIONS

This application is a continuation-in-part of U.S. patent application Ser. No. 08/411,723, filed Mar. 29, 1995, and herein abandoned.

BACKGROUND OF THE INVENTION

1. Field of the Invention

This invention relates to the field of plumbing devices, and in particular to a toilet tank that provides a pressurized stream of water to facilitate the removal of materials in the bowl.

2. Description of Related Art

A flushing device for a toilet that uses a reduced amount of water is known from EP-A-0 352 712. Two water feeds to a toilet bowl are provided in this flushing device. One water feed leads to the edge of the bowl, and the other feed leads to a trap arranged in the lower area of the bowl. During flushing, the bowl is cleaned with one flow of flushing water, and the water present in the trap is set into motion with the other flow of flushing water. The minimum amount of water necessary for an effective flushing is substantially smaller in such a flushing device than in a flushing device with only one flushing flow for cleaning the toilet bowl. In the design shown in FIG. 1 of the referenced patent, the flushing device is designed as a so-called flushing valve. To control the two flows of flushing water, a relatively complicated control device is necessary here. In addition, it is disadvantageous in this design that disturbing noises are generated during flushing despite the relatively small amount of flushing water. In addition, flushing valves are not approved in certain countries. FIG. 7 of the referenced patent shows a design in which the water used for one flushing is stored in a flushing water tank. A branch pipe, which leads to the trap of the toilet bowl, is connected to a discharge pipe of the flushing water tank. A complicated control device is necessary in this design as well, and valves and pressure indicator means, with which the two flows of flushing water are controlled, are necessary in the pipes.

Similar flushing devices are shown in EP-A-0 369 377 and EP-A-0 415 432. Complicated control and regulating units are necessary in these designs as well.

BRIEF SUMMARY OF THE INVENTION

It is an object of this invention to provide a flushing device of the class described above, which represents a substantially lower load for the water pipes than flushing valve-type devices. It is a further object of this invention to provide a flushing device that operates with less noise. It is a further object of this invention to achieve the necessary flushing effect with a minimal amount of flushing water.

These objects and others are achieved by providing a flushing device wherein a portion of the flushing water present in the flushing water tank is pressurized during the flushing process. This pressurized water is released to the outlet, which leads to the trap arranged in the lower area of the toilet bowl. It is therefore possible with the flushing device according to the present invention to accelerate the water in the trap such that this trap will be flushed better. The water of the trap is briefly set into motion, and more effective emptying of the trap is achieved. Only the toilet bowl must then be cleaned and the partially emptied trap must be refilled with the flushing flow which is subject to gravity.

Thus, an amount of pressureless flushing water and an amount of pressurized flushing water are released during one flushing in the flushing device according to the present invention. Thus, a smaller amount of flushing water is needed at equal flushing effect than with a common flushing tank. Compared with flushing valve-type devices, the flushing device according to the present invention represents a substantially lower load for the water pipes, and it corresponds to a common flushing tank in this respect.

According to a variant of the present invention, the means with which an amount of flushing water can be pressurized has a piston-and-cylinder unit with a piston, to which water of the water supply pipe can be admitted during flushing. The piston is displaced by the pressure of the water from the supply pipe, and a defined amount of flushing water present in the unit is pressurized. Such a piston-and-cylinder unit may be accommodated in a flushing tank. Such a flushing tank can then be operated with a pushbutton.

Especially effective flushing is achieved if the water present in the piston-and-cylinder unit is released with a delay under pressure by means of a control device. It can be achieved as a result that the flushing flow which is subject to gravity and the pressurized flushing flow will act essentially simultaneously in the siphon or trap. This control device nay be designed simply as a float, which actuates a servo-controlled intake valve.

The present invention also pertains to a toilet unit wherein the nozzle is arranged inclined in relation to the horizontal such that the flushing water released through the nozzle exerts a movement directed downstream to the water present in the arch of the trap.

BRIEF DESCRIPTION OF THE DRAWINGS

The invention is explained in further detail, and by way of example, with reference to the accompanying drawings wherein.

DETAILED DESCRIPTION OF THE INVENTION

Figure 1:
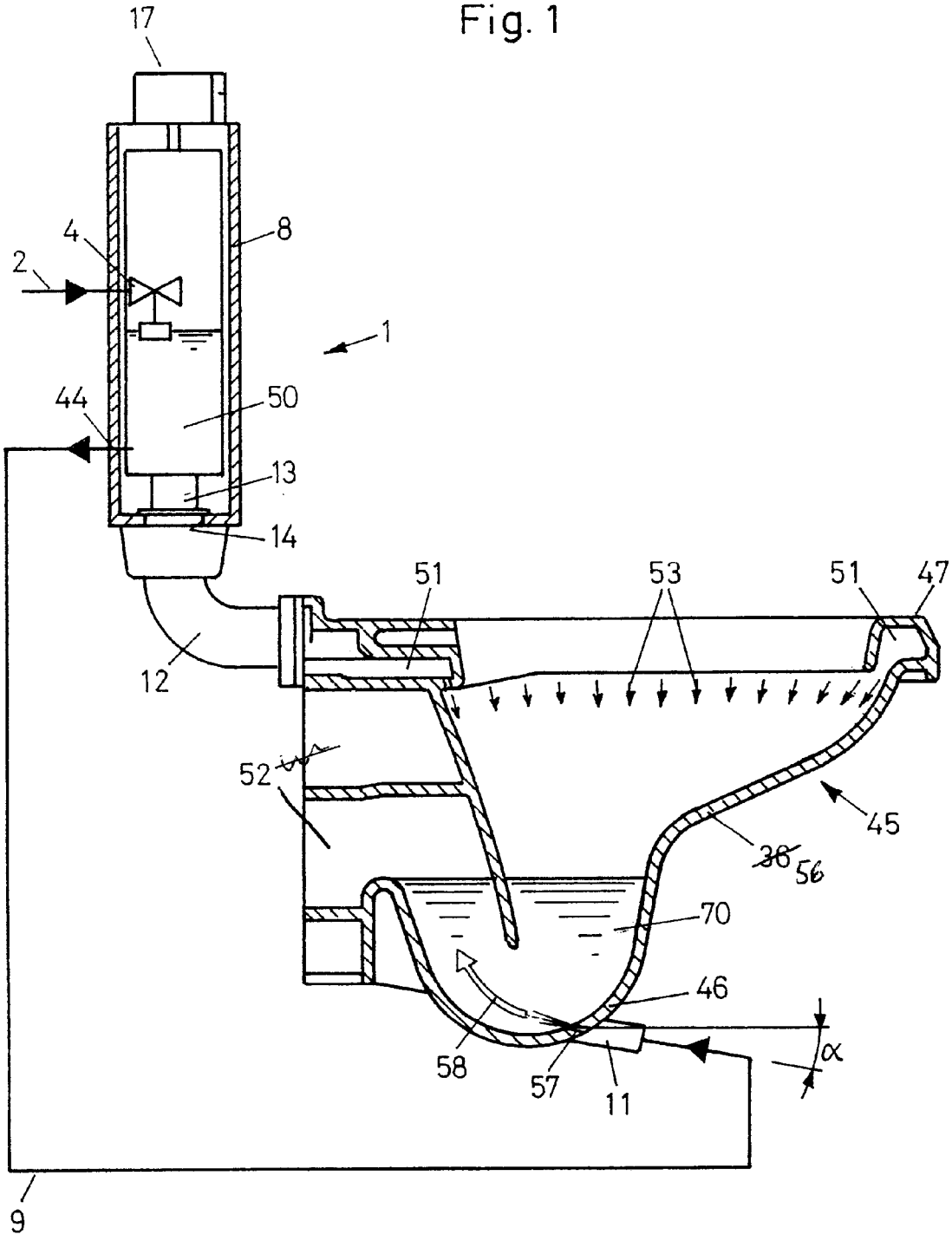
FIG. 1 schematically shows a section through a toilet unit according to the present invention.

FIG. 1 shows a flushing device 1, which is connected to a toilet bowl 45 via a pipe elbow 12. A drain valve 13, which can be actuated with an actuating means 17 to release an opening 14 in the bottom of the tank 8, is accommodated in a tank 8 of the flushing device 1. The actuating means 17 may be a button or a pushbutton or another tripping means. The tank 8 also accommodates an intake valve 4, which is connected to a water supply pipe 2. With the intake valve 4 open, the tank 8 is filled with flushing water 50 to a predetermined level. When the drain valve 13 is opened, part of the flushing water 50 flows through the pipe elbow 12 and into a channel 51 of an edge 47 and flows in the direction of the arrows 53 along the inside of a bowl area 56 in the downward direction into a U-shaped arch 46, which forms a trap against a soil pipe 52. Another, substantially smaller part of the flushing water 50 is pressurized with means in the tank 8, which are described farther below, and it enters, via a pipe 9, a nozzle 11, which has a passage 57 into the interior of the arch 46. This nozzle 11 is directed such that, as is shown in FIG. 1, water flowing in through the nozzle 11 flows in the direction of the arrow 58 into the water 70 present in the arch 46. The direction of the arrow 58 is also the direction of flow of the water 70 during the flushing process and consequently during the emptying of the trap. A suitable slope angle α can be seen in FIG. 1. This angle α is, e.g., approx. 10 degrees and is preferably smaller than 45 degrees.

The flushing flow entering through the nozzle 11 has excess pressure, while the flushing water entering the bowl area 56 through the channel 51 is only under the action of the force of gravity. The amount of flushing water flowing in through the nozzle 11 during one flushing is preferably substantially smaller than the amount of flushing water released through the channel 51. The flushing water entering the bowl under excess pressure in the direction of the arrow 58 moves the water 70 in the direction of the arrow 58 and causes the arch 46 to be better cleaned. The excrements present in the arch 46 are carried away and delivered to the soil pipe 52. Flushing water that is under the action of the force of gravity enters the bowl area 56 essentially simultaneously with the cleaning of the arch 46, and it cleans the bowl area 56. The flushing water, subject to gravity and flowing downward into the arch 46 intensifies the movement of the water 70 in the direction of the arrow 58 and refills the arch 46 with water. Thus, the two flushing flows cooperate and accelerate the water 70 in order to thus remove excrements from the arch 46.

Figure 2:
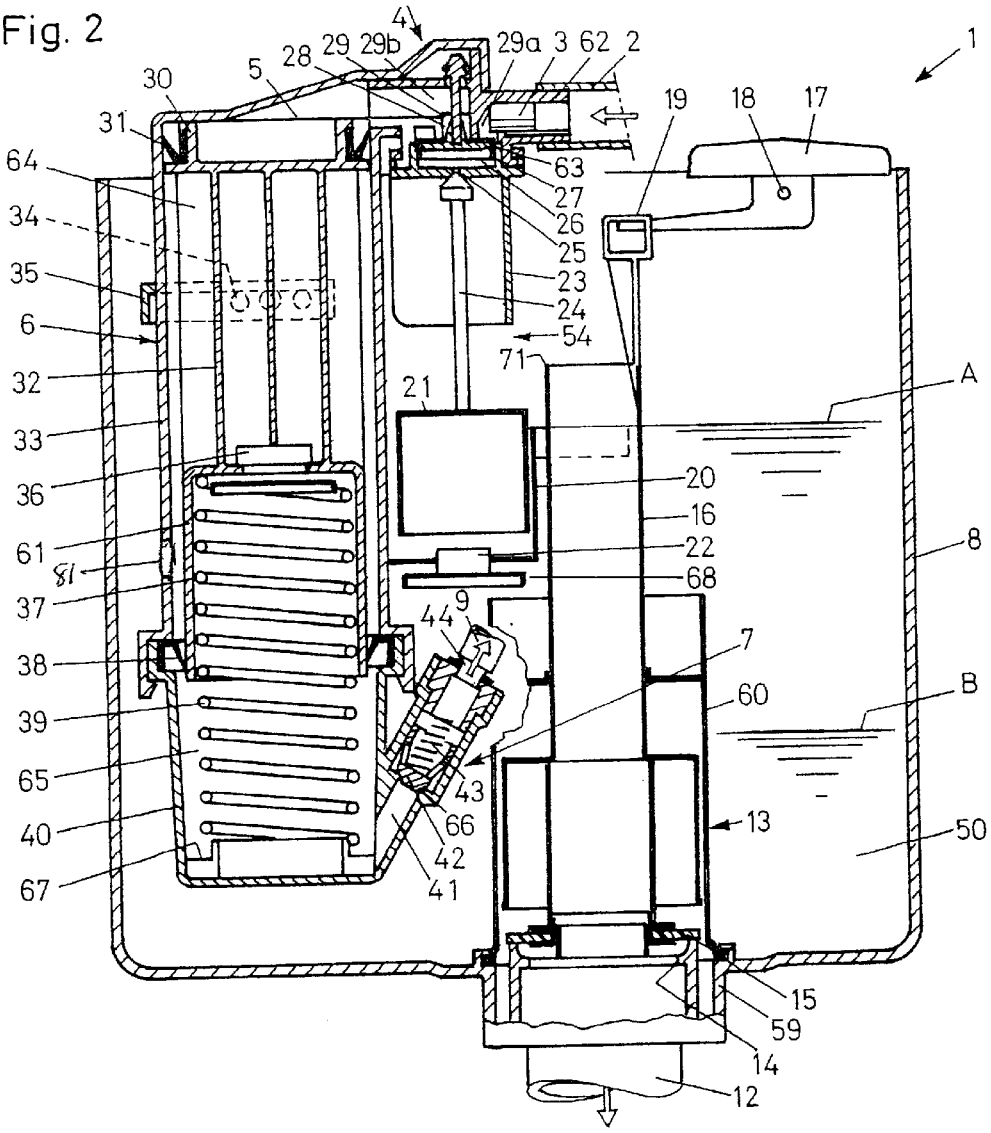
FIG. 2 shows a vertical section through a flushing device according to the present invention.
Figure 3:
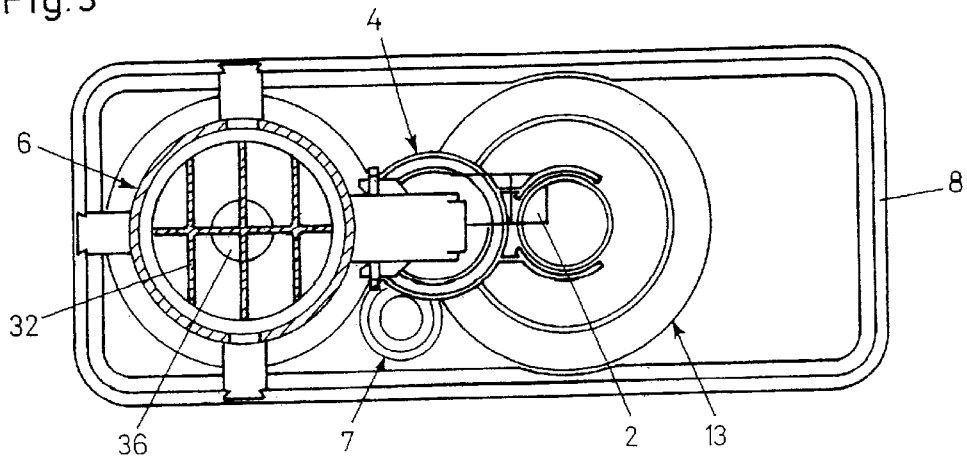
FIG. 3 shows a partially cutaway top view of the flushing device according to FIG. 2, Throughout the drawings, the same reference numerals indicate similar or corresponding features or functions.

FIGS. 2 and 3 show a preferred embodiment of the flushing device 1. The tank 8 is equipped in the usual manner with a discharge pipe connection 59 arranged in the bottom and with a lid, not shown here. The pipe elbow 12 joins the tank 8 at the pipe connection 59. The drain valve 13 may be a prior-art float valve, in which a valve pipe 16 is guided in a float housing 60. The valve pipe 16 can be raised by a ring 19 with a pushbutton 17 pivotable around a support 18. A valve disk 15 now releases the opening 14, after which flushing water 50 present in the tank 8 flows through the pipe elbow 12 and into the channel 51. The drain valve 13 automatically closes after the flushing process in the known manner.

In addition, a piston-and-cylinder unit 6, which consists essentially of two housing parts 33 and 40 and a double piston 61, is also arranged in the tank 8. The unit 6 is connected to the intake valve 4, which is connected at a connection pipe 62 to the water supply pipe 2.

The intake valve 4 is a servo-controlled diaphragm valve. This closes an opening 28 in a passage 29 with a diaphragm 27 in the state shown in FIG. 2. A passage opening 63 in the diaphragm 27 connects a chamber 29*a* of the pipe connection 62 to a chamber 26 of a frame 23. Water, which communicates with the water of the supply pipe 2 through the opening 63 and is under the same pressure, is present in the chamber 26. Since the diaphragm 27 has a larger area against the chamber 26 than against the chamber 29*a*, the latter is pressed upward against the valve seat of the opening 28. The chamber 26 has a passage 25, which is closed by a valve rod 24 mounted displaceably on the frame 23 in the arrangement shown. A float 21, which is located in a float housing 20, is arranged at the lower end of the valve rod 24. With the flushing tank filled, the float is extensively below the water level marked by the letter A. A valve 22, which is open when the flushing tank is filled and thus connects the interior of the float housing 20 to its outside, is arranged in the bottom of the float housing 20. The housing 20 is filled with water and imparts buoyancy to the float 21, which presses the rod 24 against a valve seat of the passage opening 25.

When the valve pipe 16 is lifted with the pushbutton 17 during a flushing, the water level in the tank 8 drops, and so does the water level in the float vessel 20 at the same time. Thus, the buoyancy of the float 21 thus continuously decreases, until it eventually drops down under its own weight, thus releasing the passage opening 25. Water can escape from the chamber 26 to the outside through the passage 25, as a result of which the pressure in the chamber 26 is immediately reduced. Due to the fact that the water pressure in the chamber 29*a* is now higher, the diaphragm 27 is moved downward and is lifted off from the opening 28. The passage from the chamber 29*a* to the chamber 29*b* is thus open. Water can now enter the chamber 5, which is sealed against an interior space 64 of the housing part 33 with a piston 30 and a circumferential lip seal 31, from the supply pipe 2 through the passage 29. The amount of water entering the chamber 5 per unit of time is limited by a flow governor 3 arranged in front of the diaphragm 27. The flow governor 3 is preferably set such that the water flowing into the chamber 5 has a maximum flow pressure.

The piston 30 is connected via a web 32 to a piston 37 arranged farther below it. This piston 37 has a nonreturn valve 36, which is open in the position shown and connects the interior space 64 to an interior space 65 of the housing part 40. With the valve 36 closed, the piston 37 seals the interior space 65 against the space 64 with a circumferential lip seal 38. Thus, the two pistons 30 and 37 form a double piston 61. The space 65 leads via a passage 41 to a nonreturn valve 7, which has a closing body 42, which can be lifted off from a valve seat 66 against the reactive force of a compression spring 43. The nonreturn valve 7 has a connection pipe 44, to which the pipe 9 leading to the nozzle 11 is connected.

When pressurized water flows into the chamber 5 through the opened intake valve 4, the piston 61 is moved downward by the pressure of this water against the reactive force of a compression spring 39. The space 65 is filled with water, which is pressurized by the downwardly moving piston 37 and closes the nonreturn valve 36. The water pressure in the space 65 continuously increases with the piston 37 moving downward, until the nonreturn valve 7 is opened at a defined pressure and water can flow into the pipe 9 through the passage 41 and finally to the nozzle 11. The piston 37 moves downward, until it reaches an annular surface 67 and a predetermined amount of water is displaced from the space 65 under a predetermined flow pressure.

Before the piston 37 reaches the surface 67, the lip seal 31 passes over a plurality of passage holes 34 of the housing 33. Thus, if the piston 37 is in its lower position, water flows out into the flushing tank from the chamber 5 through the passage openings 34 and fills the flushing tank until the water level A is again reached. The water flowing out through the holes 34 is deflected in the downward direction with low noise by a ring 35 arranged on the outside of the housing 33.

When the water reaches the level of the nonreturn valve 22 during the filling of the flushing tank, a closing body 68 is subjected to buoyancy, as a result of which this valve is closed. As a result, the float 21 remains in its lower position until the water 50 reaches the water level A. The intake valve 4 correspondingly remains open until the flushing tank is again completely filled. When the water level A is reached, water enters the vessel 20 over its top edge, until it is finally filled again with water, and the float 21 moves the valve rod 24 upward and closes the passage opening 25.

When the intake valve is closed, the piston 37 returns to the position illustrated in FIG. 2, via the force exerted by the spring 39. Communicating holes 81 allow water to flow from the tank into the chamber 64, and the chamber 65 is again filled with water through the non-return valve 36.

The state shown in FIG. 2, in which the flushing tank is ready for the next flushing, is thus again reached. As is apparent from FIG. 2, an overflow edge 71 of the valve pipe 16 is arranged below the holes 34 in the housing 33. A so-called water separation, which has the action of an anti-vacuum device and prevents dirty water from being drawn back into the pipeline water, is thus achieved.

In a preferred embodiment, a time delay brought about by the control device 54 is set such that flushing water is released through the nozzle 11 when the water entering the bowl area 56 through the channel 51 has reached the arch 46. When the lip seal 31 passes the openings 34 in the housing 33, the incoming water flows freely into the tank 8, and the downward pressure on the cylinder 30 is reduced. As such, the time during which water is discharged through the nozzle 11 is relatively short.

The foregoing merely illustrates the principles of the invention. It will thus be appreciated that those skilled in the art will be able to devise various arrangements which, although not explicitly described or shown herein, embody the principles of the invention and are thus within the spirit and scope of the following claims.

We claim:

1. A flushing system for a toilet, the device comprising:

an intake device for receiving fluid from a supply pipe and delivering the fluid to a tank of the toilet;

an actuating device for releasing the fluid from the tank, the actuating device being configured to release a first portion of the fluid in the tank for distribution along an edge of a bowl of the toilet, and a second portion of the fluid in the tank for injection into a trap of the bowl of the toilet;

a pressure device connected to the intake device that is configured to pressurize the second portion of fluid, the pressure device including a piston-and-cylinder unit.

2. A system in accordance with claim 1, wherein:

the pressure device pressurizes the second portion of fluid as the first portion of the fluid is released by the actuating device.

3. A system in accordance with claim 1, wherein:

the piston-and-cylinder unit includes a piston which is acted upon by the fluid from the intake device.

4. A system in accordance with claim 3, wherein:

the piston-and-cylinder unit includes a spring for moving the piston against fluid from the intake device after the actuation device has finished releasing the portions of fluid.

5. A system in accordance with claim 1, wherein:

the piston-and-cylinder unit includes a cylinder housing and a double piston positioned inside the cylinder housing, one end of the double piston being acted upon by the fluid from the intake device, and another end of the double piston forcing the second portion of fluid out of the cylinder chamber.

6. A system in accordance with claim 5, wherein:

the cylinder housing defines an opening for passing fluid from the intake device to the tank when the piston is in a predetermined position.

7. A system in accordance with claim 1, further comprising:

a flow governor positioned adjacent the intake device that is configured to limit an amount of fluid flowing through the intake device, and to cause fluid flowing into the pressure device to have a maximum pressure.

8. A system in accordance with claim 1, further comprising:

an intake valve positioned between the intake device and the tank, the intake valve selectively blocking and passing fluid flow in the supply pipe.

9. A system in accordance with claim 8, wherein:

the intake valve includes a servo-controlled diaphragm valve.

10. A system in accordance with claim 8, wherein:

the actuating device includes a control for opening the intake valve with a predetermined delay after the first portion of fluid is released.

11. A system in accordance with claim 10, wherein:

the control includes a float valve with a float and valve rod, the valve rod cooperating with a valve opening of the intake valve for servo-controlled actuation of the intake valve.

12. A system in accordance with claim 11, wherein:

the float valve includes a float housing with a nonreturn valve for delaying filling of the float housing until after the tank has been substantially filled.

13. A system in accordance with claim 1, wherein:

the actuating device delays release of the second portion of fluid by a predetermined time to cause the first and second portions to act in the trap substantially simultaneously.

14. A system in accordance with claim 1, wherein:

the pressure device pressurizes the second portion of fluid to a pressure of substantially 0.5 to 2 bar.

15. A system in accordance with claim 1, wherein:

a volume of the first portion of fluid is several times a plurality of volumes of the second portion of fluid.

16. A system in accordance with claim 1, wherein:

a second portion storage is located in the pressure device for storing the second portion of fluid in the tank prior to release of the second portion; and the pressure device is configured to pressurize the second portion in the second portion storage, the pressure device pressurizing the second portion of fluid to a pressure less than a pressure of fluid in the supply pipe.

17. A toilet unit comprising;

a tank;

an intake device for receiving fluid from a supply pipe and delivering the fluid to the tank;

first and second outlet pipes for removing a first and second portion respectively of fluid from inside the tank;

a bowl having a channel for receiving the first portion of fluid from the first outlet pipe and distributing the first portion of fluid to an edge of the bowl, the bowl also including a nozzle positioned at a trap of the bowl and for receiving the second portion of fluid from the second outlet pipe, the nozzle distributing the second portion of fluid to a trap of the bowl;

an actuating device positioned in the tank that is configured to release the fluid from the tank, the actuating device being configured to release the first portion of the fluid in the tank into the first outlet pipe, the actuating device also being configured to release the second portion of the fluid into the second outlet pipe; and a pressure device positioned inside the tank and connected to the intake device, that is configured to pressurize the second portion of fluid, the pressure device including a piston and cylinder unit.

18. A toilet unit in accordance with claim 17, wherein:

the nozzle is inclined with respect to horizontal and in a direction to exert movement of fluid inside the trap in a direction downstream to the trap.

* * * * *